US010803839B2

(12) United States Patent
Steinberger

(10) Patent No.: US 10,803,839 B2
(45) Date of Patent: Oct. 13, 2020

(54) ADJUSTABLE CAPO WITH DUAL PIVOT MECHANISM

(71) Applicant: D'Addario & Company, Inc., Farmingdale, NY (US)

(72) Inventor: Richard Ned Steinberger, Nobleboro, ME (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 16/204,071

(22) Filed: Nov. 29, 2018

(65) Prior Publication Data

US 2019/0172429 A1 Jun. 6, 2019

Related U.S. Application Data

(60) Provisional application No. 62/594,065, filed on Dec. 4, 2017.

(51) Int. Cl.
*G10D 3/053* (2020.01)

(52) U.S. Cl.
CPC ..... *G10D 3/053* (2020.02)

(58) Field of Classification Search
CPC ..... G10D 3/043
See application file for complete search history.

(56) References Cited

U.S. PATENT DOCUMENTS 7,939,736 B2 * 5/2011 Campling ..... G10D 3/043 84/315
8,779,262 B1 * 7/2014 Steinberger ..... G10D 3/043 84/318

* cited by examiner

*Primary Examiner* — Kimberly R Lockett
(74) *Attorney, Agent, or Firm* — Alix, Yale & Ristas, LLP

(57) ABSTRACT

An adjustable capo for a stringed musical instrument includes a front jaw with a top arm and a rear jaw with a bottom arm. The rear jaw is pivotally attached to the front jaw about a first axis with the top arm biased rotationally in a direction toward the bottom arm about the first axis. The bottom arm is attached to a rear handle in a pivotal relationship about a second axis that is independent from the first axis. An adjuster is configured to adjust the pressure applied by the top arm on the strings of a musical instrument when the instrument neck is clamped between the top arm and bottom arm.

20 Claims, 12 Drawing Sheets

ADJUSTABLE CAPO WITH DUAL PIVOT MECHANISM

BACKGROUND

The disclosed embodiments relate to a capo for use with a stringed musical instrument, and in particular a capo with a main bias member, such as a torsion spring, and an adjustment member for adjusting the positioning of the bottom arm relative to an attached rear handle.

Capos are well-known devices in the musical arts used to change the pitch of a stringed instrument. Capos allow the use of chords or different chord versions that would not be available to the musician if he tried to play them on a stringed musical instrument without the capo. The use of a capo enables the musician to use chords in positions that include more open string combinations. Open strings tend to have unique sound characteristics that are desirable in many musical situations.

Capos typically are clamped onto or otherwise attached to the neck of a stringed instrument with an arm or similar element overlying the strings with a pad held against the strings. Known clamping mechanisms include, for example, screw, ratchet, and spring force. One popular variety of capo uses spring force to bias the arms of the capo toward one another in a closed or clamped position. Spring biased capos exist that utilize one of a compressed coil spring or a torsion spring to bias the arm toward the clamped position.

Torsion spring capos are desired for aesthetic purposes because a coil spring is far more visible when in use. However, to this point, torsion spring capos are not adjustable, so they generally deliver a high level of clamping force on the neck of the instrument, and consequently the strings, at all times. Tension in coil spring capos can be adjusted to deliver varying amounts of clamping force for use with instruments having necks of different types, thicknesses or shapes, or even different strings. Adjustability of spring tension is advantageous, as it is preferable to attach a capo to a neck against the strings with a clamping pressure as low as possible while still maintaining the strings at the desired pitch. Over-clamping can increase string tension and degrade tuning accuracy.

It would be useful to have an alternate capo that operates via bias force from a torsion spring while also allowing adjustment of clamping pressure on the instrument neck and strings.

SUMMARY

Disclosed herein is an adjustable capo for use with a stringed musical instrument having a front jaw with a top arm and a rear jaw with a bottom arm. The rear jaw is pivotally attached to the front jaw about a first axis A1 and includes a rear handle. The bottom arm is pivotally engaged with a rear handle and pivotable about a second axis. A first bias member biases the front jaw in a first rotational direction about the first axis A1, thereby causing the top arm to be biased toward the bottom arm. An adjustment member is configured to adjust the rotational position of the bottom arm relative to the rear handle about the second axis.

In another embodiment, an adjustable capo for use with a stringed musical instrument includes a front jaw with a top arm for contacting the strings of the musical instrument. A rear jaw is pivotally attached to the front jaw and has a bottom arm spaced from the top arm in an opposing relationship. A first bias member biases the front jaw and rear jaw rotationally relative to one another such that the top arm and bottom arm are biased toward one another about a first axis A1, and such that a pressure P is applied on the strings of the instrument by the top arm when the capo is attached with the instrument neck trapped between the top arm and bottom arm. The capo includes an adjustment member for adjusting the amount of pressure P applied by the top arm on the strings when attached with the instrument neck trapped between the top arm and bottom arm.

In yet another embodiment a capo for use with a stringed musical instrument comprises a front jaw with a top arm and a rear jaw with a bottom arm. The rear jaw is movably attached to the front jaw. A first bias member biases one or both of the front jaw and the bottom jaw such that the top arm is biased in a first direction toward the bottom arm. An adjuster is configured to adjust the distance between the front jaw and rear jaw independent of the first bias member and independent of the first direction of movement.

BRIEF DESCRIPTION OF THE DRAWINGS

Preferred embodiments of the disclosed capo are described herein with reference to the accompanying drawings, wherein like numerals represent like elements throughout, in which.

DETAILED DESCRIPTION

In addition to the benefits and improvements disclosed herein, other objects and advantages of the disclosed embodiments will become apparent from the following wherein like numerals represent like parts throughout the several figures. Detailed embodiments of an adjustable capo with a torsion spring bias member and dual pivot mechanism are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
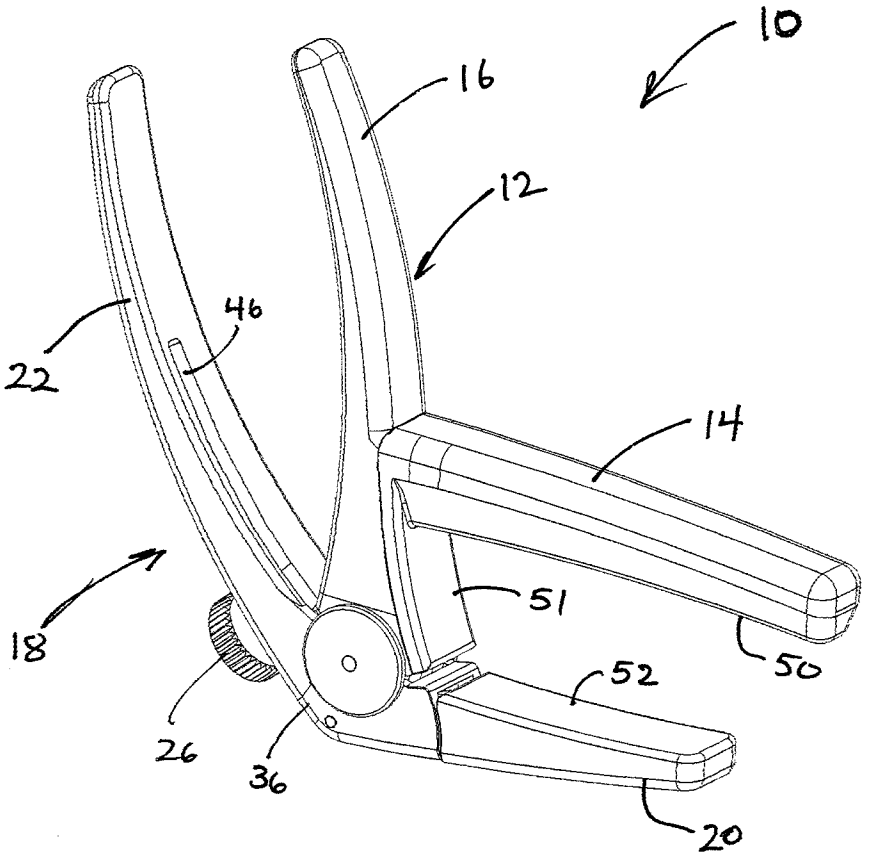
FIG. 1 is a front perspective view of an embodiment of the disclosed adjustable capo with dual pivot mechanism.
Figure 2:
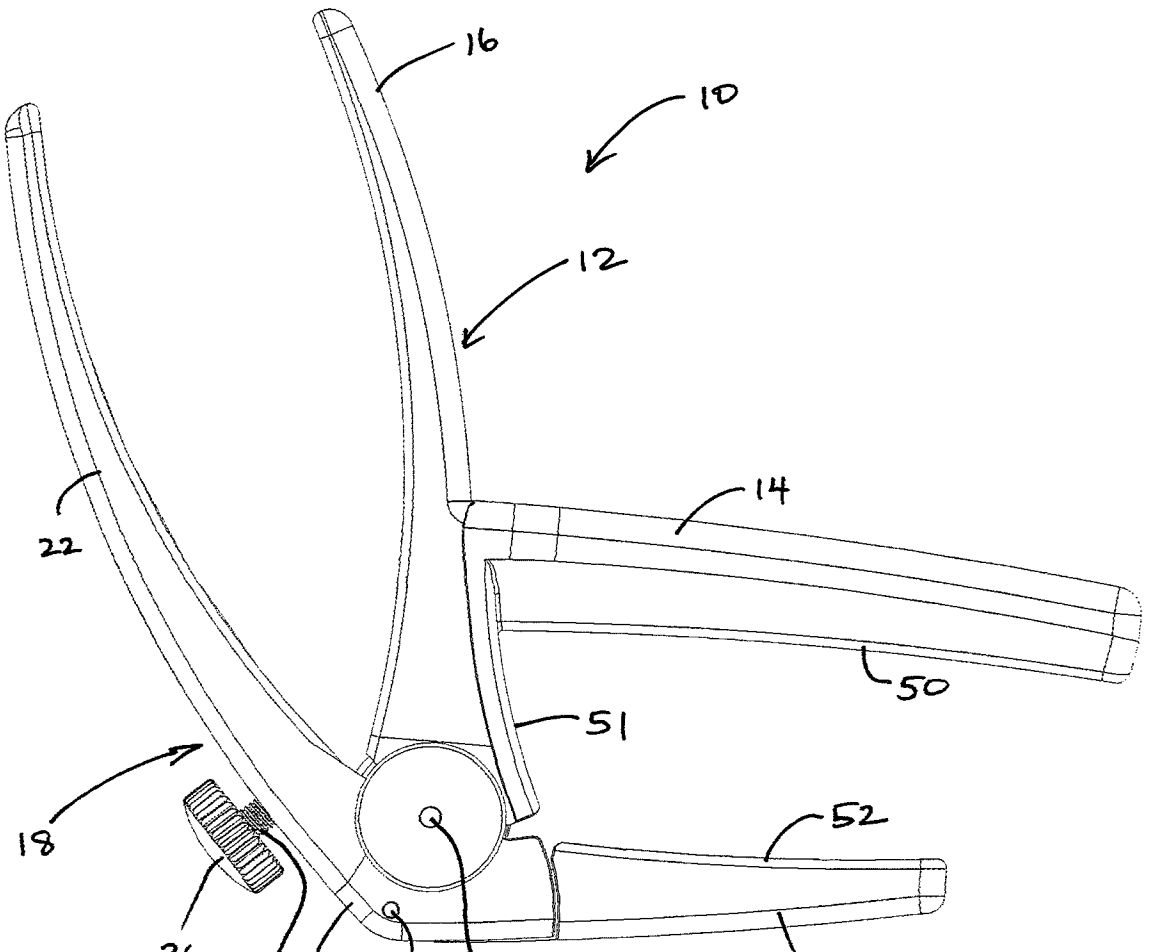
FIG. 2 is a side elevation view of the disclosed capo.
Figure 3:
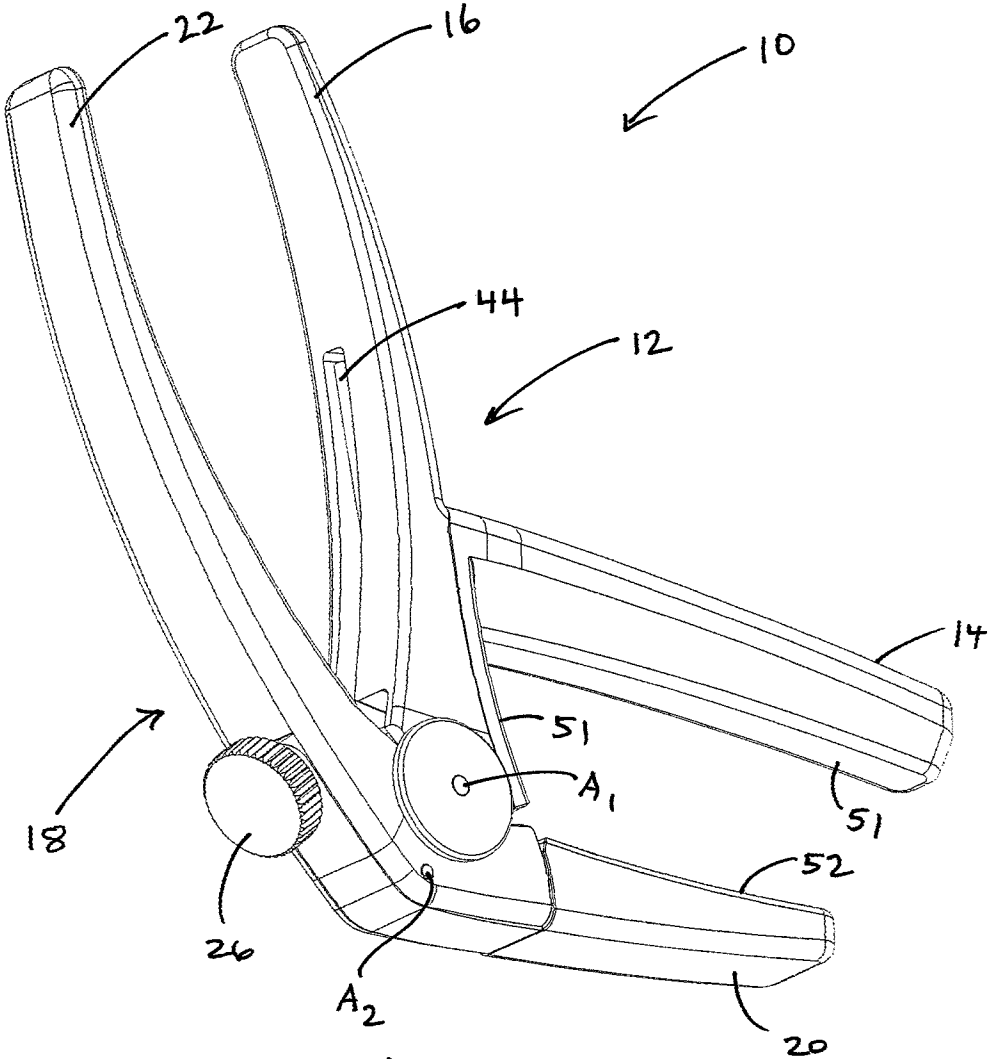
FIG. 3 is a rear perspective view of the disclosed capo.
Figure 4:
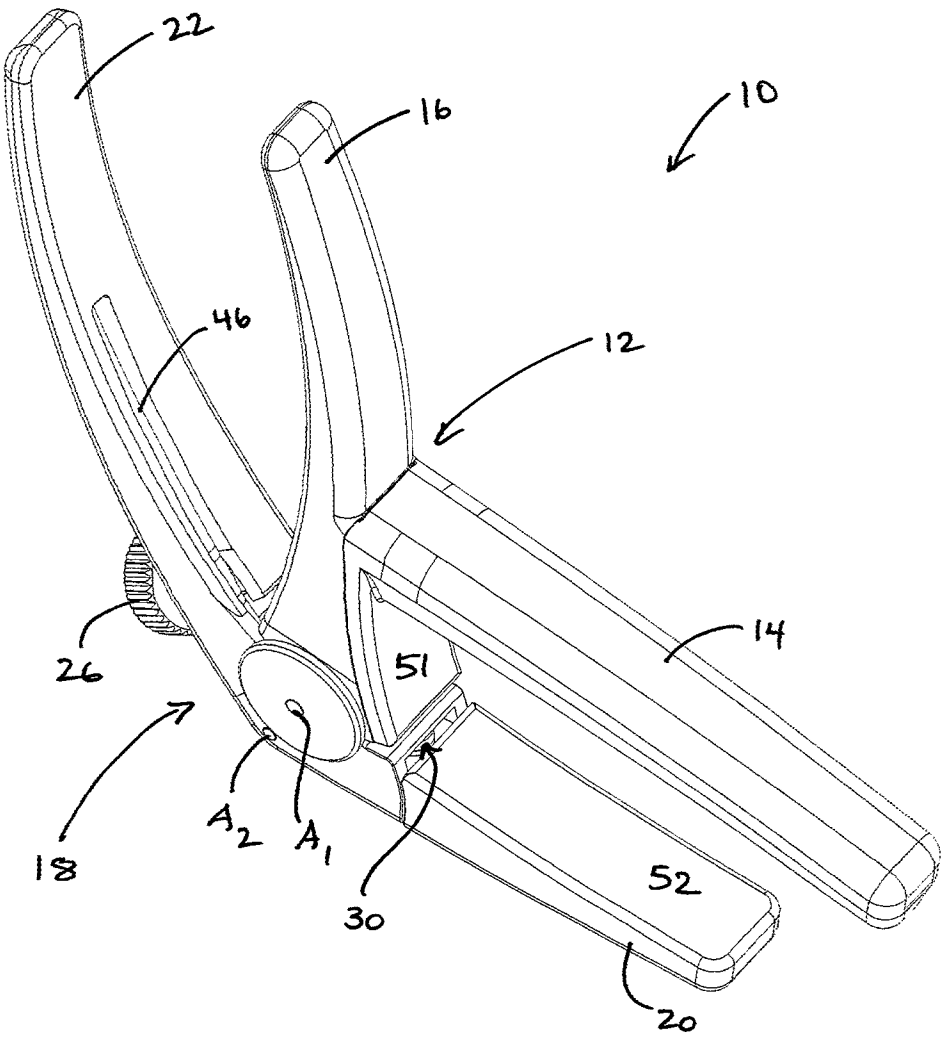
FIG. 4 is a top perspective view of the disclosed capo.

With reference to the Figures, disclosed herein are embodiments of a capo 10 and 100 operable via a primary bias member 24/124, i.e., torsion spring. As shown initially in FIGS. 1-6B, a first embodiment of the capo 10 includes a front jaw member 12 with a top arm 14 and a rigid front handle 16. The front jaw member 12 is attached in a pivotable arrangement with a rear jaw member 18 having a rear handle 22 that carries a bottom arm 20 in a pivotable arrangement. As will be discussed in detail below, the pivoting relationship between the bottom arm 20 and rear handle 22 is independent from the pivoting relationship between the front jaw member 12 and rear jaw member 18. A torsion spring 24 is positioned in engagement with the front and rear jaw members, 12 and 18, with a pin extending through the center of the spring helix 42 to define the primary axis $A_1$ of rotation between the front jaw member 12 and rear handle 22. As shown in FIGS. 3 and 4, respectively, a front leg 44 of the torsion spring 24 engages the rear of the front handle 16 and a rear leg 46 of the spring 24 engages the front of the rear handle 22.

Figure 5:
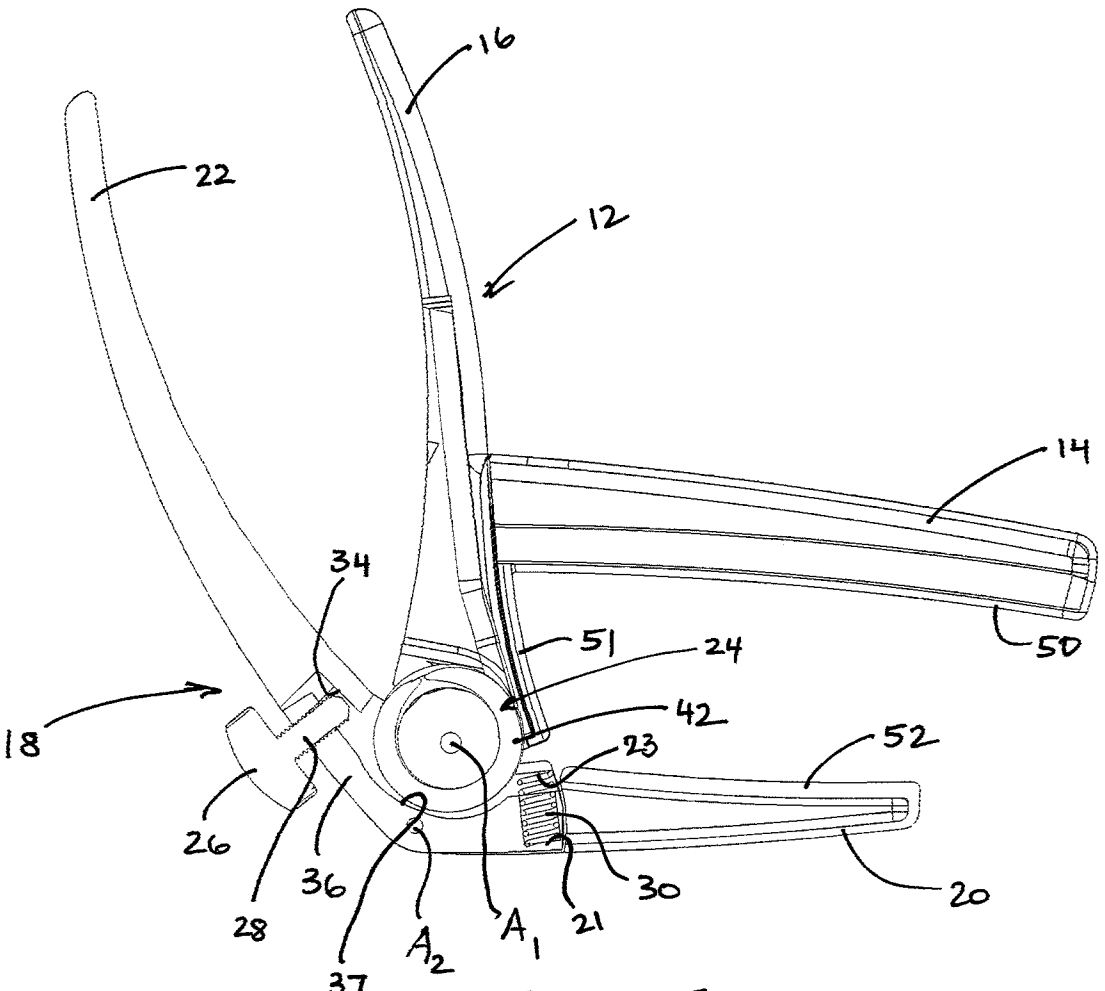
FIG. 5 is a cross-sectional view of the disclosed capo.
Figure 6A:
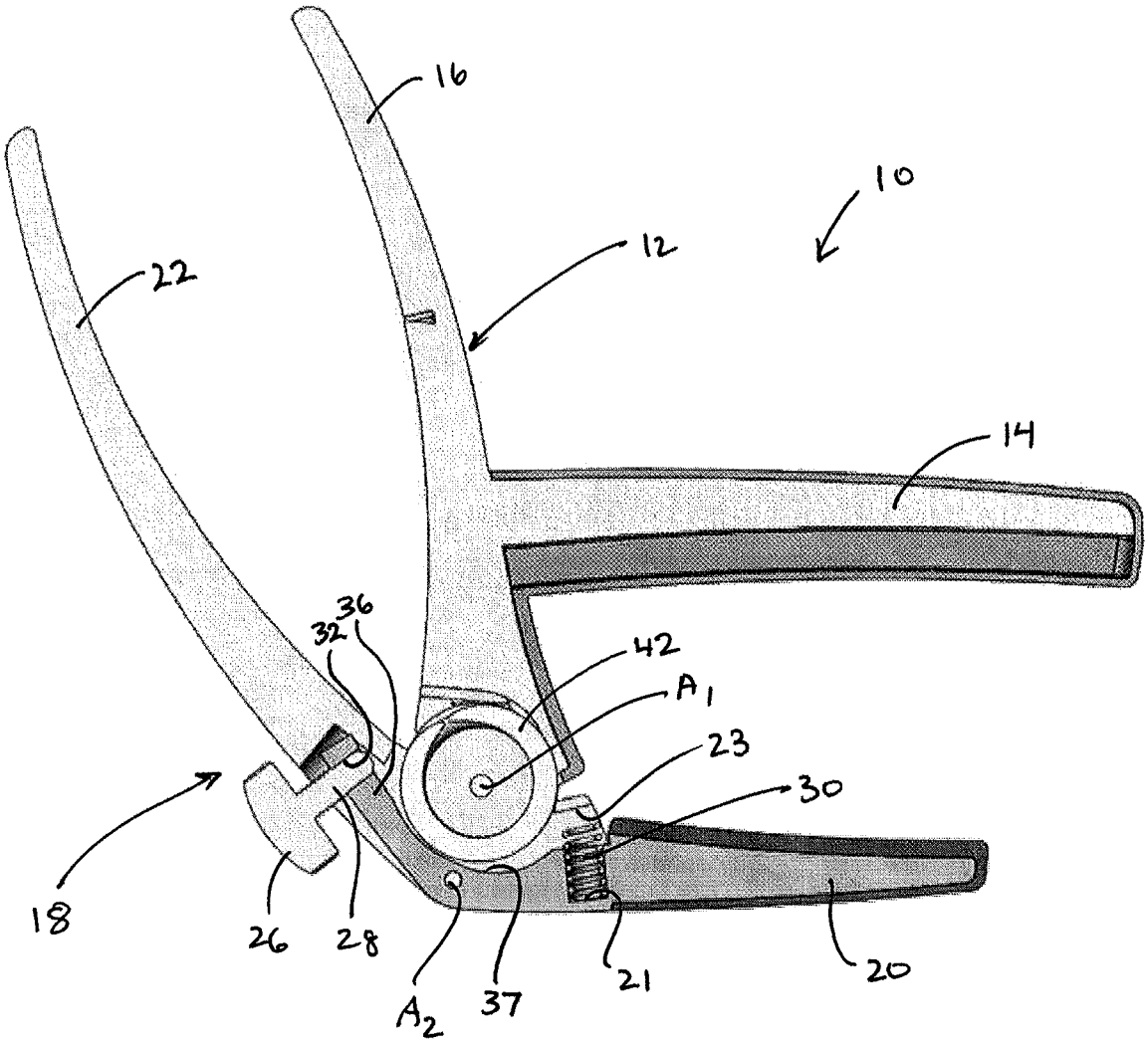
FIG. 6A is a cross-sectional view of the disclosed capo showing an expanded position of the bottom arm.
Figure 6B:
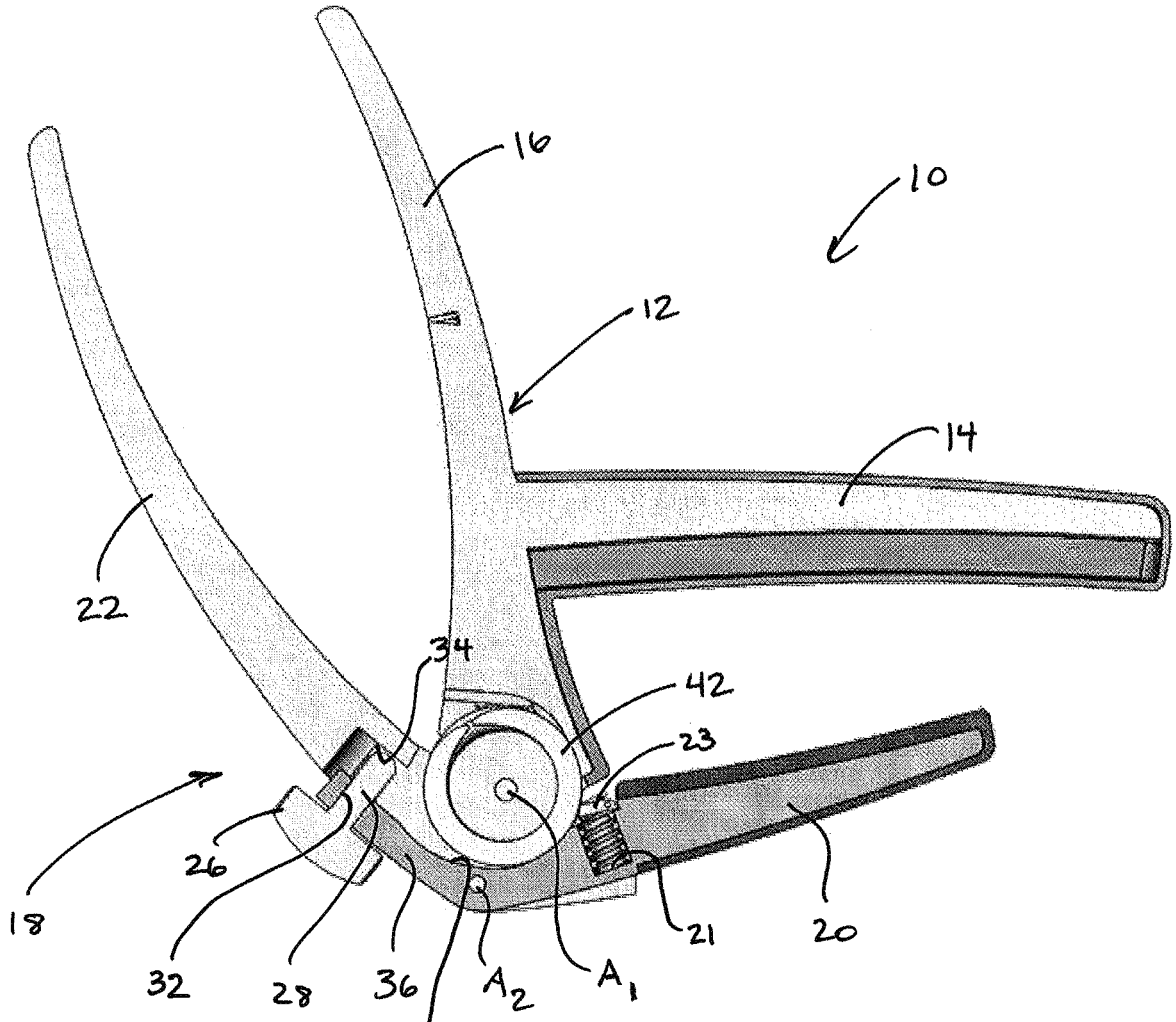
FIG. 6B is a cross-sectional view of the disclosed capo show a tightened position of the bottom arm.

As shown most clearly in the cross-sectional views of FIGS. 5, 6A and 6B, the bottom arm 20 is not integral with the rear handle 22, and instead is engaged toward the terminal end of the rear handle 22 via a second pin and pivotable relative to the rear handle about a second axis $A_2$. A second bias member 30 (in this embodiment, a compression spring), is positioned between respective surfaces of the bottom arm 20 and the rear handle 22 on one side of the second axis $A_2$ to bias the bottom arm away from the rear handle (toward an expanded position; clockwise in the view of FIG. 5). More specifically, the second bias member 30 is contained in abutment with an inner surface 23 of the rear handle 22 and an opposite inner surface 21 of the bottom arm 20. The bottom arm 20 includes a rear leg 36 extending obliquely in the direction toward the rear handle 22. The rear leg 36 includes a threaded bore 32 on an opposite side of the axis $A_2$ from the second bias member 30. An adjustment knob 26 with threaded shank 28 is threaded through the bore 32 with the distal end of the shank 32 in abutment with an inner surface 34 of the rear handle 22. As shown, the transition of the bottom arm 20 to the rear leg 36 forms an inner partial circumferential surface 37.

The top arm 14 includes at least one pad 50 or similar resilient layer at least across its inner surface for contacting the instrument strings when the capo is in use clamped to the instrument neck. In the depicted embodiment, the top arm pad 50 includes a side portion 51, which may abut the side edge of the instrument neck when attached to protect the neck surface from scratches or other damage. Similarly, the rear arm includes a pad 52 over its distal end, which primarily provides protection to the rear surface of the instrument neck from damage, and may additionally have a tacky texture to assist in maintaining robust attachment of the capo 10 to the instrument.

Again with reference to the cross-sectional views of FIGS. 5, 6A and 6B, the second bias member 30 biases the front portion of the bottom arm 20 rotationally rearward about the second axis $A_2$ (clockwise in the depictions), thereby biasing the rear leg 36 into the rear handle 22. The adjustment knob 26 is used to adjust the rotational position of the bottom arm 20 relative to the rear handle 22 (independent from the first axis $A_1$), thus, adjusting the natural position of the bottom arm 20 relative to the top arm 14.

FIG. 6A depicts an expanded position of the bottom arm 20. In the expanded position, the shank 28 is unthreaded from the bore, which allows the expansion force from the compression spring 30 to rotate the bottom arm 20 rearwardly (clockwise in FIG. 6A) relative to the rear handle 22 about the second axis $A_2$ until the rear leg 36 abuts the inner surface 23 of the rear handle. As shown, this spring-biased rearward rotation about the second axis $A_2$ "expands" the distance between the bottom arm 20 and top arm 14. FIG. 6B depicts a tightened position of the bottom arm 20. In the tightened position, the shank 28 is fully threaded into the bore 32, which causes the front arm 20 to rotate forward (counterclockwise in FIG. 6B) relative to the rear handle 22 about the second axis $A_2$ against the bias from the spring 30. As shown, the threading of the shank "tightens" the distance between the bottom arm 20 and top arm 14.

In the depicted embodiment, the shank 28 can be threaded into the bore until the head of the knob 26 abuts the outer surface of the rear leg 36. Other embodiments exist wherein the extent of threading (and thus the angular range of motion of the bottom arm) is limited in other ways, such as a stop on the front side of the second axis $A_2$. While not depicted in FIG. 6A or 6B, a user can thread the shank 28 to any intermediate position between the expanded (FIG. 6A) and tightened (FIG. 6B) positions to adjust the clamping force on the instrument neck (discussed in further detail below).

The main torsion spring 24 biases the capo 10 toward a clamped position at all times by biasing the front handle 16 and rear handle 22 rotationally away from one another about the first axis $A_1$. A user typically opens the capo 10 by gripping the respective handles, 16 and 22, and pinching them toward one another to overcome the torsion spring bias. In that opened state, the capo 10 can be positioned in the desired location on the instrument neck and then released, causing the capo 10 to clamp closed onto the instrument neck in an attached position with the top arm pad 50 maintained against the instrument strings at a pressure P from the force of the torsion spring.

As discussed generally above, the adjustment knob 26 and independent pivoting mechanism between the bottom arm 20 and rear handle 22 may be used to adjust the clamping force of the capo 10, and ultimately, the pressure P on the strings of the instrument. Specifically, the more that the knob 26 is threaded into the bore 32 to tighten the bottom arm 20, the greater the clamping pressure P will be on the strings because the natural positioning of the bottom arm 20 is closer to the top arm 14, resulting in a tighter clamp when the capo 10 is closed over the instrument neck. Conversely, as the knob 26 is unthreaded from the bore, the natural positioning of the bottom arm 20 is expanded further from the top arm 14, resulting in a more relaxed clamp on the instrument neck.

Figure 7:
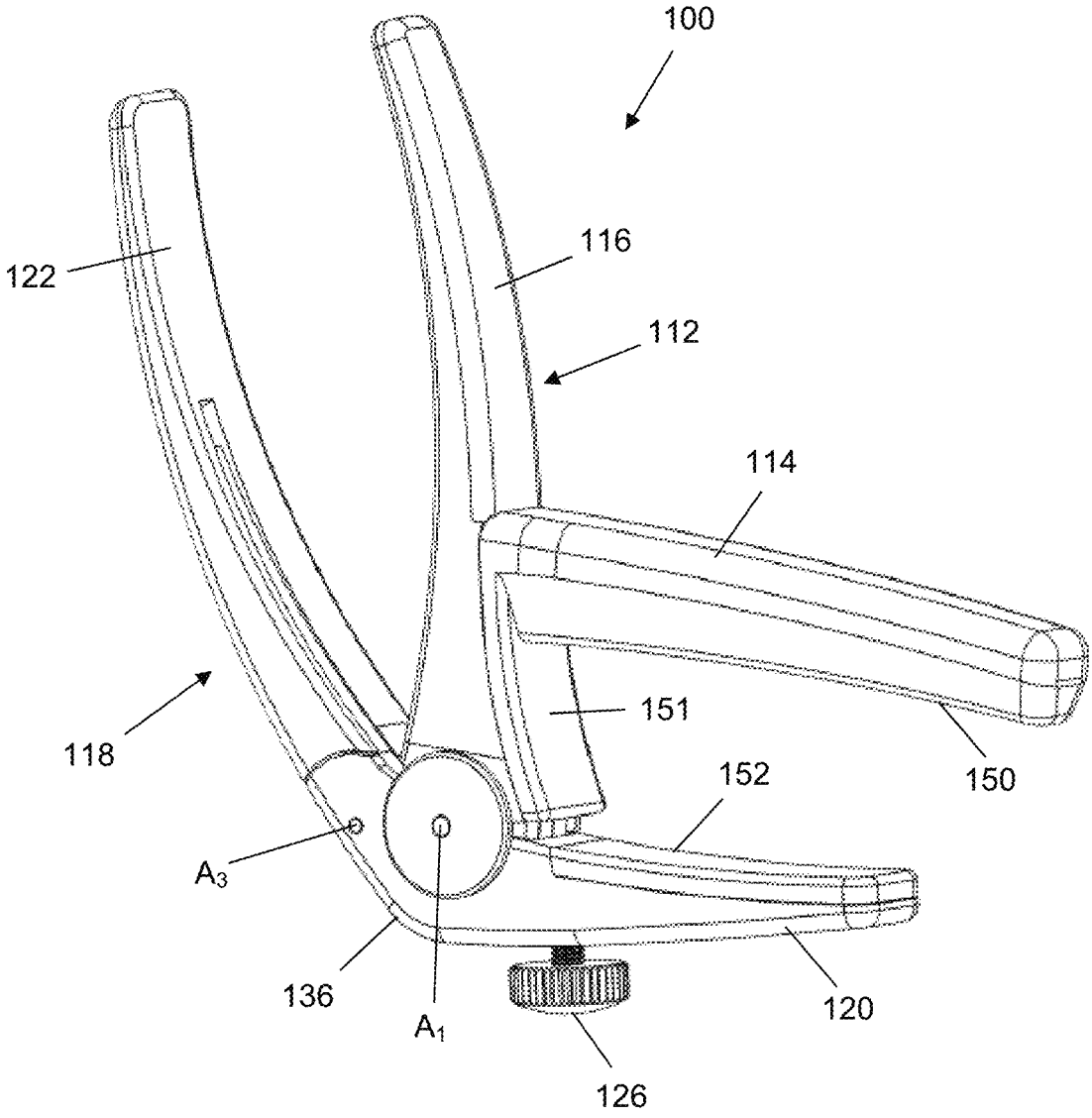
FIG. 7 is a perspective view of another embodiment of the disclosed adjustable capo.

FIG. 7 depicts an additional embodiment of the adjustable dual-pivot capo 100. This embodiment of the capo 100 includes many elements common to the earlier disclosed adjustable capo 10. Note that elements in the capo 100 shown in FIGS. 7-10 that are common to the capo 10 of FIGS. 1-6B are referenced with common trailing two numerals and an a leading numeral "1" for consistency. A front jaw 112 includes a top arm 114 extending from a front handle 116. A rear jaw 118 is attached to the front jaw 112 in a pivotable relationship about an axis $A_1$ defined by a pin or similar connecting element. The rear jaw 118 includes a bottom arm 120 that is attached and pivotable relative to a rear handle 122 independent from the primary pivot axis $A_1$. The top arm 114 carries a resilient pad 150 which may include a side portion 151, while the bottom arm 120 carries a pad 152 for improved tackiness and/or to protect of the instrument neck from scratches and scuffs.

Figure 8:
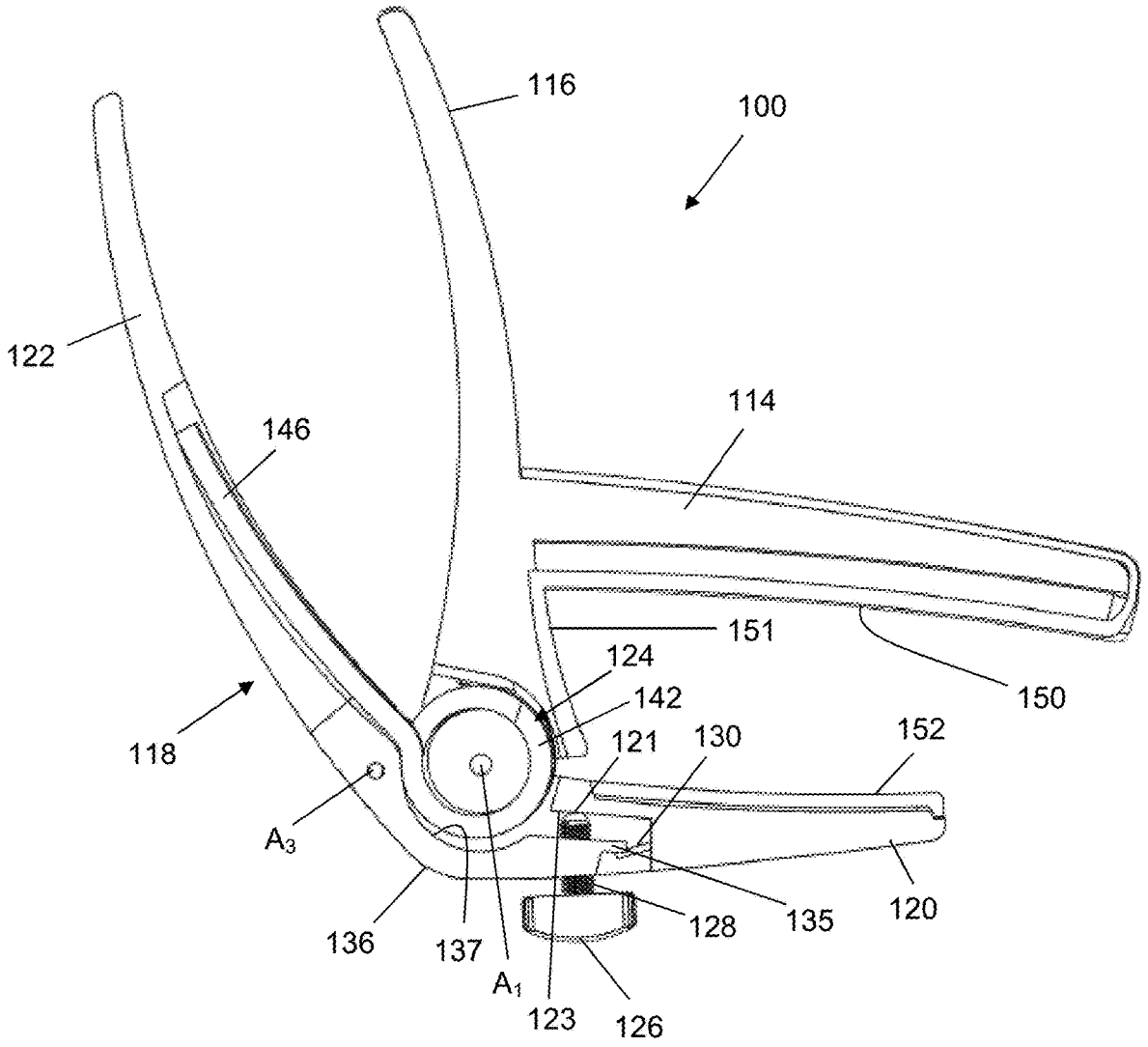
FIG. 8 is a partial cross-sectional view of the capo of FIG. 7 in a position with intermediate spring tension.
Figure 9:
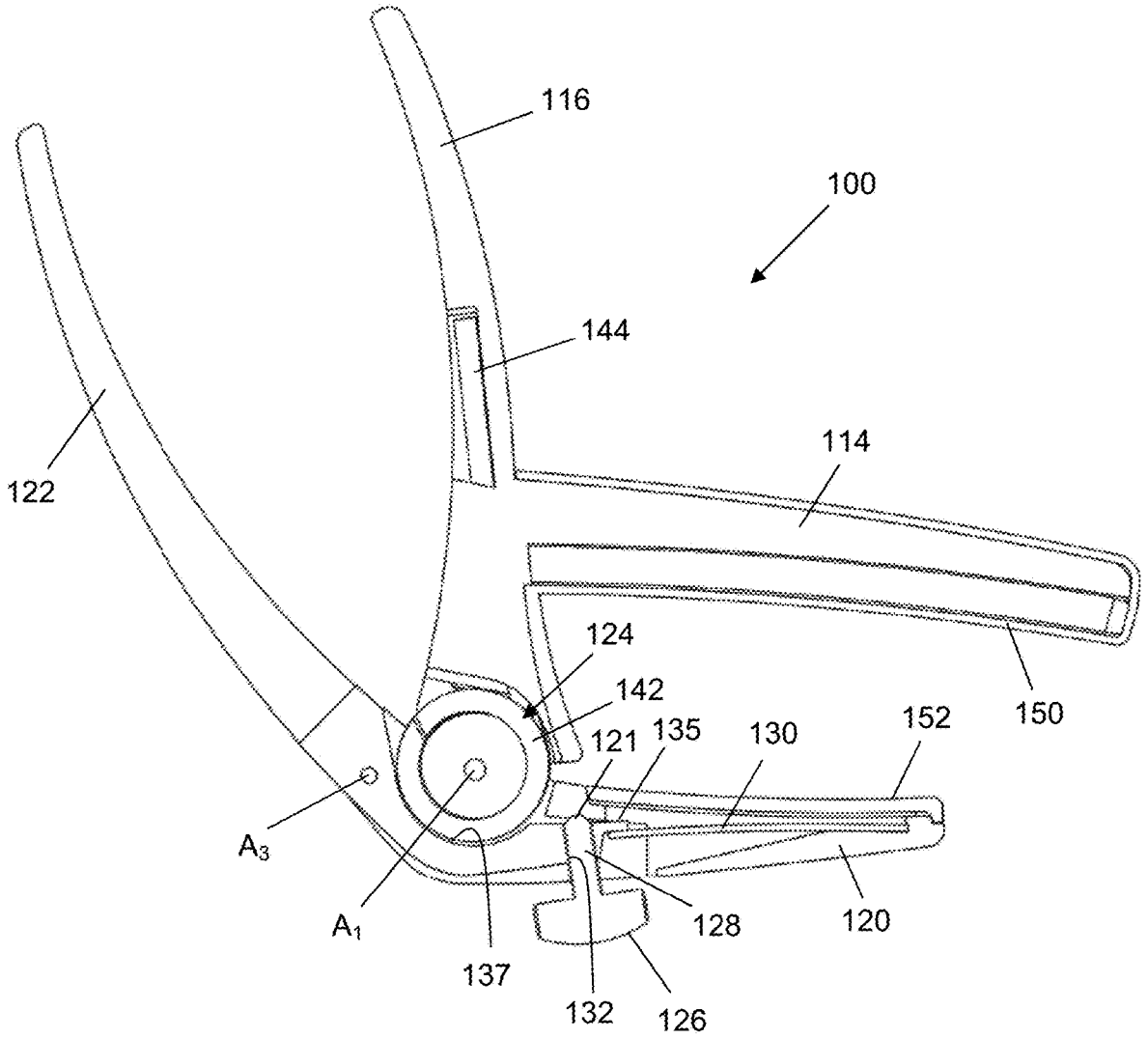
FIG. 9 is a partial cross-sectional view of the capo of FIG. 7 in a position with high spring tension.
Figure 10:
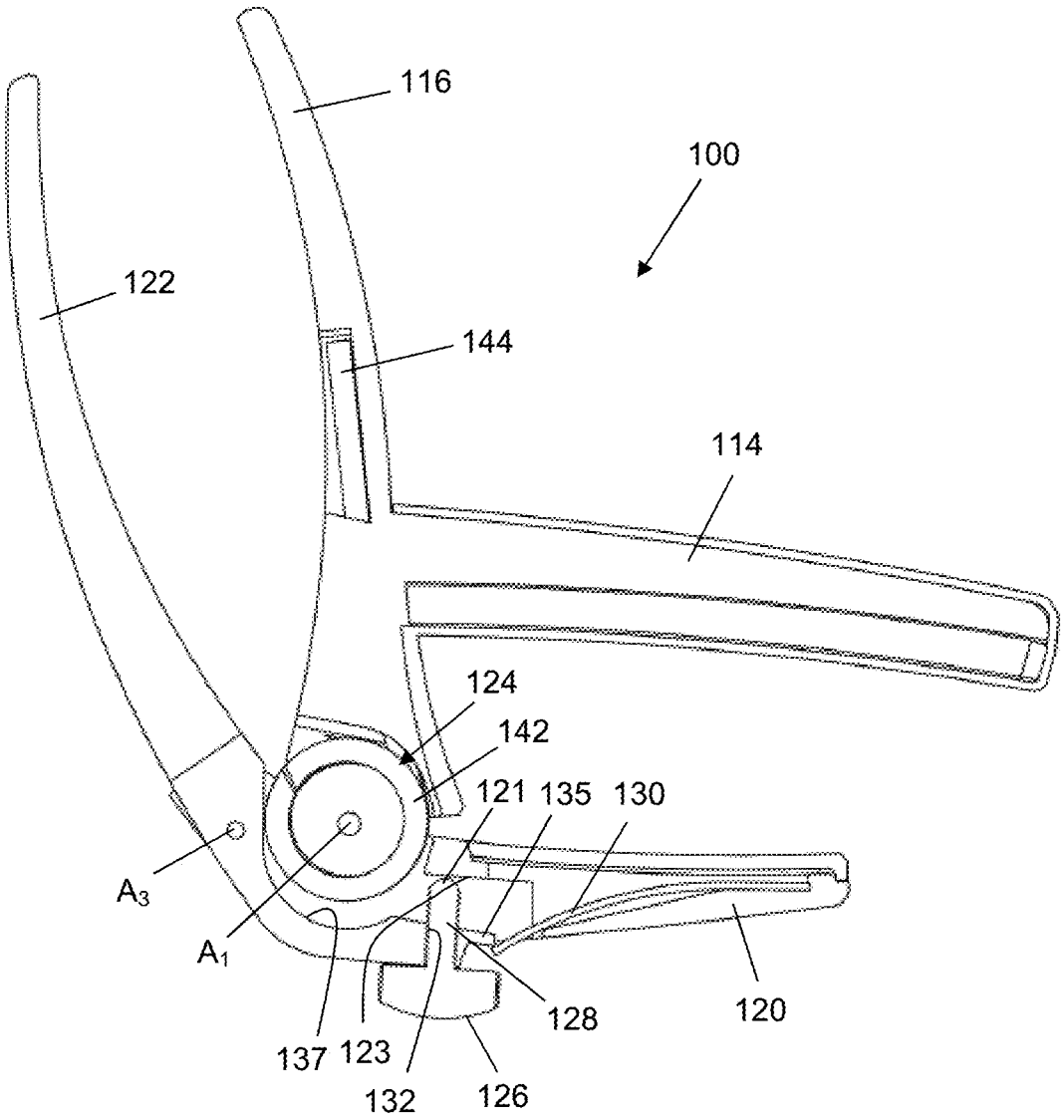
FIG. 10 is a partial cross-sectional view of the capo of FIG. 7 in a position with low spring tension.

Also like the previous embodiment of the capo 10, the adjustable capo 100 includes a primary bias member 124, which is preferably a torsion spring, to bias the front jaw 112 and the rear jaw 118 in a clamped configuration (with the opposing top arm 114 and bottom arm 120 biased toward each other). The torsion spring 124 engages the front and rear jaws, 112 and 118, with a pin extending through the center of the spring helix 42 to define the primary axis $A_1$ of rotation between the front jaw 112 and rear handle 122. As shown in FIGS. 8-10, a front leg 144 of the torsion spring 124 engages the rear of the front handle 116 and a rear leg 146 of the torsion spring 124 engages the front of the rear handle 122, thereby biasing the handles rotationally away from one another about the primary axis $A_1$. As will be discussed in greater detail below with reference to FIG. 11, the torsion spring 124 can be formed of a rectangular prismic wire and/or include additional design characteristics, such as bends, to complement its arrangement within the capo.

This embodiment of the adjustable capo 100 includes a secondary axis $A_3$ defined by a pin or similar element, connecting the bottom arm 120 to the rear handle 122 and an adjustment knob 126. With reference to FIGS. 7-10, the positioning of the adjustment knob 126 and secondary axis $A_3$ is reversed relative to the primary axis $A_1$ in this embodiment of the capo 100 as compared to the earlier embodiment of the capo 10. In this embodiment, the primary axis $A_1$ is defined by a pin extending through the helix 142 of the torsion spring 124 which mechanically connects the front jaw 112 to the rear jaw 118 and allows them to pivot relative to one another. The secondary axis $A_3$ is defined by a pin that is substantially parallel to the primary axis pin and connects the bottom arm 120 to the rear handle 122 independent from the top jaw 112. As shown, in this embodiment, a rear leg 136 is not formed integrally with the bottom arm 120, but is rather formed integrally with the rear handle 122 and attached to the bottom arm 120. The adjustment knob 126 includes a threaded shank 128 threadedly mated with a bore 132 in the front portion of the leg 136 and abuts an inner surface 123 of the bottom arm 120. A leaf spring 130 is positioned within the bottom arm 120 to bias front lip 135 of the leg 136 rotationally toward the rear of the bottom arm 120 (i.e., the lip 135 is biased counterclockwise in FIGS. 8-10).

The level of primary spring tension, and thus clamping pressure on the neck and strings of the musical instrument, is adjustable via the adjustment knob 126. However, in this embodiment, the distance between the top arm 114 and bottom arm 120 remains relatively constant in favor of articulation of the handles, 116 and 122, relative to one another. In both embodiments, 10 and 100, adjustment via the respective adjustment member 26/126 pivots the bottom arm 20/120 relative to the rear handle 22/122 to control pressure delivered by the top arm 14/114 to strings of the instrument.

In the embodiment of the capo 100, threading and unthreading of the adjustment knob 126 causes cooperative pivoting about both the primary axis $A_1$ and secondary axis $A_3$, such that the rear handle 122 pivots relative to the front handle 116 without significantly adjusting the relative distance between the top arm 114 and bottom arm 120.

FIG. 9 shows the capo 100 in a low spring tension position with the adjustment knob 126 fully unthreaded. In the low tension configuration, the rear handle 122 is at a maximum distance from the front handle 116. As the shank 123 is unthreaded from the bore 132, the rear leg 146 of the torsion spring 124 acts to "open" the handles, 116 and 122 (i.e., extend the distance between respective handles) without moving the bottom arm 120 relative to the top arm 114. This relieves some tension in the torsion spring 124.

As the adjustment knob 126 is threaded into the bore 132, the tip 121 of the shank 128 presses against the inner surface 123 of the bottom arm 120, causing the oblique leg 136 to pivot clockwise relative to the position shown in FIG. 9 against the bias from the torsion spring 124. As the handles, 122 and 116, are forced closer to one another against the opening bias of the torsion spring 124, tension in the torsion spring increases. FIG. 8 shows the capo 100 in a position with intermediate spring tension.

FIG. 10 shows the capo 100 in a high spring tension position. In the depicted high tension position, the shank 128 of the adjustment knob 126 is fully threaded into the bore 132. This forces the leg 136 further rearward (clockwise in FIGS. 8-10), thereby further closing and tightening the handles, 116 and 122, against the opening bias from the torsion spring. Understandably, as the respective legs of the torsion spring, 144 and 146, are forced toward one another, the tension in the torsion spring increases. In any positioning, the leaf spring 130 acts to maintain the bottom arm 120 and rear handle 122 rotationally fixed relative to one another, thereby causing the bottom arm 120 to open as the handles, 116 and 122, are squeezed (to open the capo 100). In other words, the leaf spring 130 holds the inner surface 121 of the bottom arm 120 against the tip of the shank 128, assuring that when the handles, 116 and 122, are squeezed manually, the bottom arm 120 opens from the top arm 114 to accommodate or release the neck of the instrument.

The greater the tension in the torsion spring 124, the greater the clamping pressure P will be on a given instrument neck when attached, and vice versa. As with the earlier embodiment of the capo 10, the capo 100 is fully adjustable to any positioning between the highest tension with the adjustment knob 126 fully threaded (FIG. 10) and the lowest tension with the adjustment knob 126 fully unthreaded (FIG. 9). As such, the pressure P on the instrument neck and strings can be adjusted to an optimal or otherwise preferred value.

Figure 11:
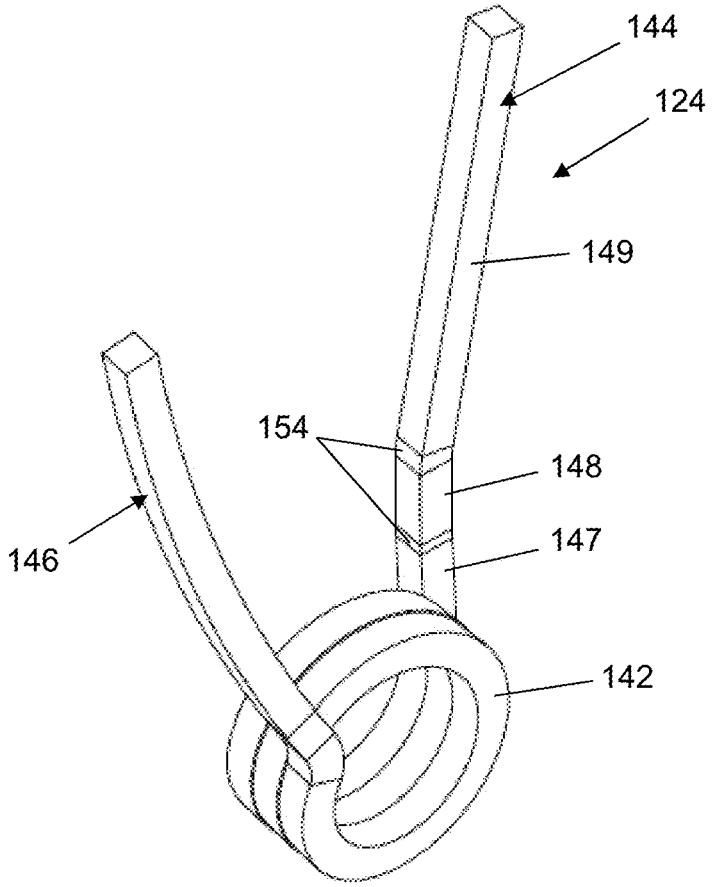
FIG. 11 shows an exemplary embodiment of a torsion spring for use within the disclosed adjustable capo.

FIG. 11 depicts a preferred embodiment of a torsion spring 124 for use with the inventive capo 100. As shown, the torsion spring 124 has a rectangular (or approximately square) cross-sectional shape. Additionally, the front leg 144 includes a plurality of bends 154, which form angled segments, 147, 148 and 149, shaped to assist mating with the rear portion of the front jaw 112. The rectangular prismic shape of the wire forming the torsion spring 124 yields a spring that is stiffer than a torsion spring of a similar size and gauge formed of a cylindrical wire (i.e., circular cross-section). This is due to the presence of a greater length at the bending area caused by the straight edges with sharp corners relative to a circumferential position on a cylindrical wire. A stiffer spring 124 provides the capo 100 with increased clamping power, which is an advantageous property in an adjustable capo, as it allows a greater range of clamping pressures within the articulation range of the rear handle (in the capo 100) or bottom arm (in the capo 10). Notably, the torsion spring 124 can be used in a multitude of different capos, including the disclosed embodiments of the adjustable capo 10 and 100.

In typical operation of either embodiment of the capo 10 and 100, adjustment via the knob 26/126 is performed prior to clamping on the instrument, however, the inventive concepts described herein are not limited as such. In this manner a user can vary (increase or decrease) the clamping pressure P to advantageously apply the optimal or otherwise desired amount of pressure P on the instrument strings when already clamped to the instrument neck. The adjustable capo 10 and 100 can effectively accommodate a variety of shapes and sizes of instrument necks by applying optimal pressure P and minimizing or eliminating the drawbacks associated with overclamping.

The embodiments of the adjustable capo, 10 and 100, can be formed from any appropriate materials, such as a metal or rigid molded polymer with steel springs and pads made of silicone, rubber or a similar resilient material. These materials are clearly non-limiting to the inventive concepts of providing a capo with two separate and independent pivoting axes to allow adjustment of clamping pressure via an adjustment member, as described herein.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A capo for use with a stringed musical instrument, comprising:

a front jaw comprising a top arm;

a rear jaw pivotally attached to the front jaw about a first axis A1, the rear jaw including a bottom arm pivotally engaged with a rear handle and pivotable about a second axis different from the first axis;

a primary bias member biasing the front jaw in a first rotational direction about the first axis A1, thereby causing the top arm to be biased toward the bottom arm; and an adjustment member, wherein the adjustment member is configured to adjust the rotational position of the bottom arm relative to the rear handle about the second axis, and the top arm and bottom arm are configured to trap a neck of a stringed instrument between them.

2. The capo of claim 1, wherein adjustment of the rotational position of the bottom arm relative to the rear handle via the adjustment member does not substantially alter the positioning of the bottom arm relative to the top arm.

3. The capo of claim 1, wherein adjustment of the rotational position of the bottom arm relative to the rear handle via the adjustment member alters the distance between the bottom arm and the top arm.

4. A capo for use with a stringed musical instrument, comprising:

a front jaw comprising a top arm for contacting the strings of the musical instrument;

a rear jaw pivotally attached to the front jaw and comprising a bottom arm spaced from the top arm in an opposing relationship;

a primary bias member biasing the front jaw and rear jaw rotationally relative to one another such that the top arm and bottom arm are biased toward one another about a first axis $A_1$ and such that a pressure P is applied on the strings of the instrument by the top arm when the capo is attached with the instrument neck trapped between the top arm and bottom arm; and an adjustment member for adjusting the amount of pressure P applied by the top arm on the strings when attached with the instrument neck trapped between the top arm and bottom arm, wherein the primary bias member is a torsion spring with one leg abutting the front jaw and another leg abutting the rear jaw to bias the top arm toward the bottom arm, the torsion spring including a helix through which the first axis $A_1$ passes.

5. The capo of claim 4, wherein the adjustment member comprises a knob with a threaded shank mated within a threaded bore in the rear jaw, and wherein threading of the shank in a first direction increases the amount of pressure P applied by the top arm on the strings when attached with the instrument neck trapped between the top arm and bottom arm.

6. The capo of claim 5, wherein threading of the shank in the first direction forces the rear jaw to pivot about the first axis $A_1$ against the primary bias member, thereby increasing tension in the primary bias member.

7. The capo of claim 5, wherein threading of the shank in a second direction opposite of the first direction decreases the amount of pressure P applied by the top arm on the strings when attached with the instrument neck trapped between the top arm and bottom arm.

8. The capo of claim 7, wherein threading of the shank in the second direction opposite of the first direction allows the rear jaw to pivot about the first axis $A_1$ under bias from the primary bias member, thereby decreasing tension in the primary bias member.

9. The capo of claim 8, wherein threading of the shank in a second direction allows the rear jaw to pivot about the first axis $A_1$ under bias from the primary bias member, thereby decreasing tension in the primary bias member and decreasing the amount of pressure P applied by the top arm on the strings when attached with the instrument neck trapped between the top arm and bottom arm.

10. A capo for use with a stringed musical instrument, comprising:

a front jaw comprising a top arm;

a rear jaw comprising a bottom arm movably attached to the front jaw;

a primary bias member biasing one or both of the front jaw and the bottom jaw such that the top arm is biased in a first direction toward the bottom arm; and an adjuster for adjusting the distance between the front jaw and rear jaw independent of the primary bias member and independent of the first direction of movement, wherein the top arm and bottom arm are configured to trap a neck of a stringed instrument between them.

11. The capo of claim 10, wherein the rear jaw is pivotally attached to the front jaw about a first axis $A_1$, the primary bias member biases the rear jaw and front jaw rotationally about the first axis $A_1$ in a first rotational direction.

12. The capo of claim 11, wherein the primary bias member is a torsion spring that includes a helix through which the first axis $A_1$ of rotation of the rear jaw relative to the front jaw passes.

13. The capo of claim 11, wherein the rear jaw comprises a rear handle pivotally attached to the bottom arm about a second axis $A_2$, comprising a second bias member that biases the bottom arm in a second rotational direction about the second axis $A_2$.

14. The capo of claim 10, wherein the rear jaw comprises a rear handle and the bottom arm is pivotably attached to the rear handle about a second axis $A_2$.

15. The capo of claim 10, comprising a second bias member for biasing the bottom arm in a second direction from the rear handle.

16. The capo of claim 10, wherein the rear jaw comprises a rear handle pivotally attached to the bottom arm about a second axis $A_2$ independent from the first axis $A_1$, the bottom arm extends from a terminal front end to an obliquely extending rear leg, and the second axis $A_2$ is positioned between the front end and the rear leg.

17. The capo of claim 16, wherein the adjuster comprises a knob with a threaded shank threadedly received by a threaded bore in the rear leg.

18. The capo of claim 17, comprising a second bias member biasing the bottom arm away from the top arm, wherein threading of the shank into the bore causes the bottom arm to rotate about the second axis $A_2$ in a third direction against the bias of the second bias member, and threading of the shank out from the bore causes the bottom arm to rotate about the axis $A_2$ in the second direction under bias from the second bias member.

19. The capo of claim 18, wherein threading the shank into the bore tightens the distance between the bottom arm and the top arm, and unthreading the shank from the bore expands the distance between the bottom arm and the top arm.

20. The capo of claim 10, wherein the front jaw further comprises a rigid handle and the rear jaw further comprises a rear handle that opposes the rigid handle, and wherein forcing the handles toward each other opens the top arm away from the bottom arm against the bias from the primary bias member.

* * * * *